United States Patent [19]

Deutsch

[11] 4,211,138

[45] Jul. 8, 1980

[54] HARMONIC FORMANT FILTER FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Japan

[21] Appl. No.: 917,920

[22] Filed: Jun. 22, 1978

[51] Int. Cl.[2] ..... G10H 1/06

[52] U.S. Cl. ..... 84/1.01; 84/1.03; 84/1.19; 84/DIG. 9; 364/723; 364/724

[58] Field of Search ..... 84/1.01, 1.03, 1.19, 84/1.21, 1.24, 1.25, DIG. 9; 364/718, 721, 724, 723

[56] References Cited

U.S. PATENT DOCUMENTS

| | | | |
|---|---|---|---|
| 3,809,789 | 5/1974 | Deutsch | 84/1.01 |
| 3,929,053 | 12/1975 | Deutsch | 84/1.24 |
| 3,956,960 | 5/1976 | Deutsch | 84/DIG. 9 |
| 3,972,259 | 8/1976 | Deutsch | 84/1.24 |
| 4,022,098 | 5/1977 | Deutsch | 84/1.03 |
| 4,036,096 | 7/1977 | Tomisawa | 84/1.01 |
| 4,082,028 | 4/1978 | Deutsch | 84/1.24 |
| 4,136,398 | 1/1979 | Eggermont | 364/718 |

*Primary Examiner*—Gene Z. Rubinson
*Assistant Examiner*—William L. Feeney
*Attorney, Agent, or Firm*—Christie, Parker & Hale

[57] ABSTRACT

A fixed formant filter for a digital electronic instrument of the type in which musical tones are generated from waveshape data calculated independently of frequency of the tone from constituent generalized Fourier components. The Fourier components are individually scaled by scale factors selected from a set of stored scale factors which define the transfer characteristic of the fixed formant filter. Each separately addressable stored scale factor corresponds to a different frequency value in the musical scale. A scale factor is selected for separately scaling each harmonic of the tone generated in response to the particular note of the musical scale keyed on the instrument. The selected scale factors may be modified by a frequency deviation signal to provide vibrato or other frequency modulation effects. The selected scale factors are also corrected for any frequency deviation between the actual frequency of the harmonic of the keyed note being scaled and the frequency value associated with the selected scale factor.

6 Claims, 7 Drawing Figures

HARMONIC FORMANT FILTER FOR AN ELECTRONIC MUSICAL INSTRUMENT

FIELD OF THE INVENTION

This invention relates to a fixed formant filter for an electronic musical instrument, and more particularly, is concerned with a digital type filter.

BACKGROUND OF THE INVENTION

Digital tone generators for musical instruments are well known in which the waveshape of a tone is the same for each musical note. In other words, the harmonic contents of each musical note over the full range of the musical scale is substantially the same. The harmonic content can be modified to provide different waveshapes, as by setting "Stops". Such tone generation is particularly suited to electronic musical instruments that are intended to imitate the tonal characteristics of pipe organs. However, most other musical instruments have resonant characteristics which do not change with the pitch of the note being produced. Thus the tones for notes sounded up and down the scale do not exhibit constant harmonic structure. Rather the harmonic structure can be characterized by a signal whose spectral content is modified by passing the signal through a fixed filter. The use of fixed filters on the output signals of analog type tone generators is well known. The use of fixed filters on the analog output signals of a digital tone generator, of course, can be used to produce the same audio effects. However, the design of conventional analog filters to emulate the transfer characteristics of various acoustical instruments results in rather complex filter designs. Moreover, to make such filters variable so as to provide resonances at various frequencies becomes impractical for anything but the simplest transfer characteristics.

The use of digital techniques to provide fixed format filtering has heretofore been proposed for use in a computer organ. See, for example, U.S. Patent No. 3,956,960. In the computer organ described in this patent the amplitudes of a series of points defining the waveshape of the tone being generated are computed in real time by summing, for each point in time, the amplitudes of each of the Fourier components of the desired waveshape. Filtering is accomplished by applying a scale factor to the amplitude coefficient of each Fourier component, the scale factor being selected according to the frequency of the Fourier component. Selection of the scale factor for each Fourier component is derived from a frequency number R whose value is determined by the particular key operated on the keyboard of the instrument. Frequency information is essential in the computer organ during the computation of the amplitude values in real time. The same frequency information is therefore available to select the appropriate scale factor as a function of frequency to scale the Fourier components in conformance with the transfer characteristics of the fixed formant filter.

The present invention is directed to a fixed formant filter particularly suited for use in a polyphonic digital tone synthesizer of the type described in U.S. Pat. No. 4,085,644. In the polyphonic tone synthesizer, waveshape information is computed by calculating its constituent generalized Fourier components and summing the Fourier components to form a master data set corresponding to the amplitudes of a series of points defining the waveshape of one cycle (or half cycle) of the tone to be generated. The amplitude defining words of the master data set are then transferred sequentially at a rate determined by the fundamental frequency of the tone being generated to a digital-to-analog converter which converts the master data set to an analog voltage of the desired waveshape. Calculation of the master data list is entirely in the harmonic mode and is independent of the pitch of the note being generated. The present invention provides a means for scaling the Fourier components during calculation of the master data set such that the master data set conforms to a waveshape which is dependent on the pitch of the note being generated, i.e., a waveshape modified by a fixed formant filter. The invention is an improvement over the formant filter described in the above-identified U.S. Pat. No. 3,956,960 in that it does not require a frequency dependent R number. Moreover, the present invention provides a fixed formant filtering characteristic for a frequency modulated tone. Also, an interpolation feature allows a relatively small number of scale factors, less than twice the number of notes on the keyboard, to be used in producing relatively complex filter transfer characteristics.

SUMMARY OF THE INVENTION

These and other advantages of the present invention are achieved by providing, in a polyphonic tone synthesizer of the type described in U.S. Pat. No. 4,085,644, a formant memory storing a set of scale factors, each scale factor corresponding to a discrete frequency and having a magnitude which corresponds to the relative attenuation at that frequency of the desired fixed formant filter. By changing the relative magnitude of the scale factors stored in the formant memory, any desired fixed formant filter characteristic can be applied to the tone generated by the synthesizer. A scale factor in the formant memory is addressed in response to the particular keyed note being generated by the tone generator and the particular harmonic component being analyzed in computing the master data set. The addressed scale factor is read out of the formant memory and used to scale the particular harmonic component being computed. The scale factor read out of the formant memory is modified by adding a correction factor which adjusts for how much the actual frequency of the harmonic of the tone being generated differs from the frequency associated with the scale factor from the formant memory. The scale factor is further modified in response to a frequency deviation signal which causes the tone to be frequency modulated about the nominal pitch or fundamental frequency.

DESCRIPTION OF THE DRAWINGS

For a more complete understanding of the invention reference should be made to the accompanying drawings, wherein.

DETAILED DESCRIPTION

Figure 1:
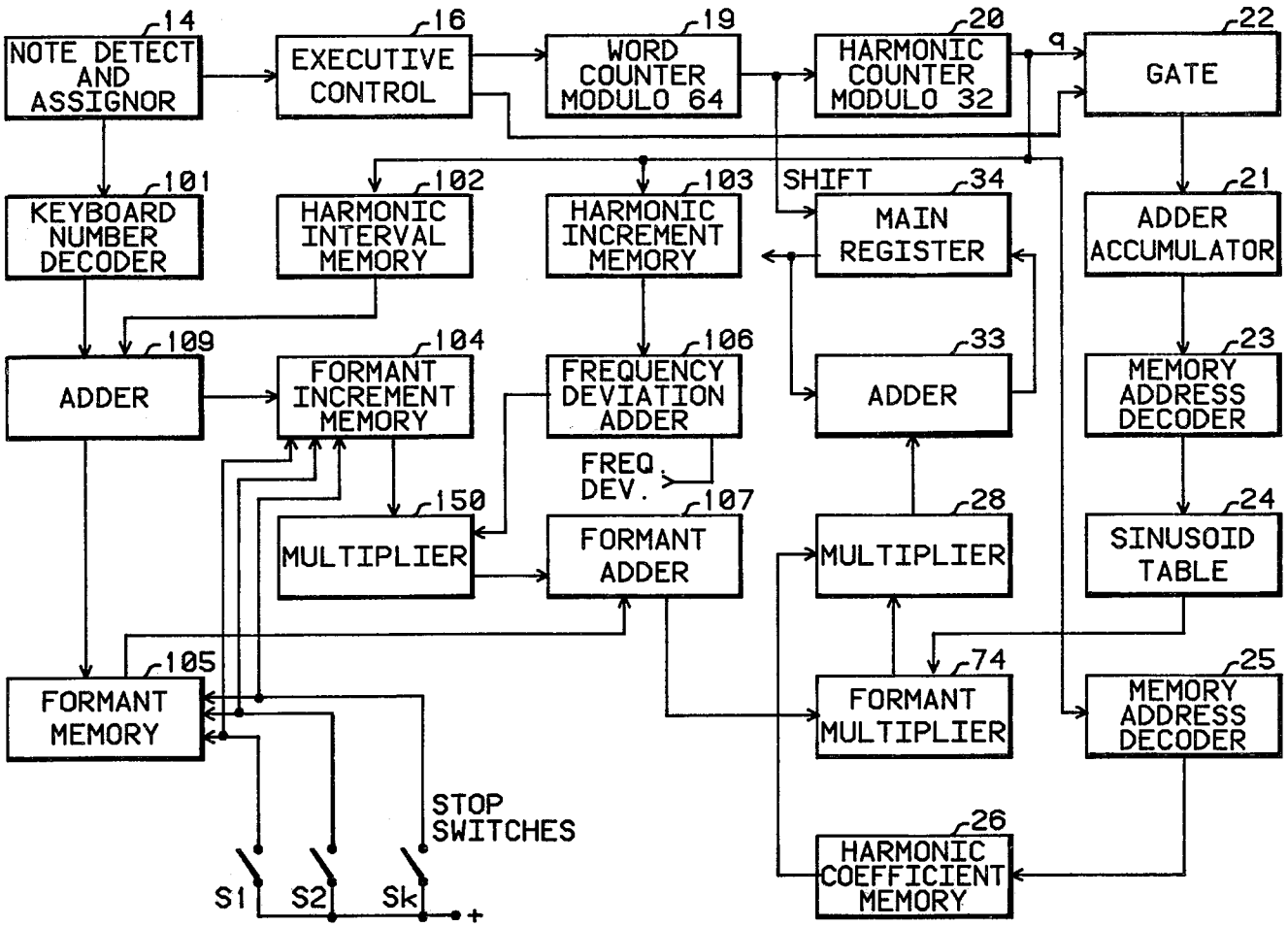
FIG. 1 is a schematic block diagram of one embodiment of the present invention.

The preferred embodiment of the present invention is described as an improvement to the polyphonic digital tone synthesizer described in U.S. Pat. No. 4,085,644, hereby incorporated by reference. The polyphonic tone synthesizer is a musical instrument of a type having one or more keyboards. Typically, each keyboard includes six octaves of keys with one key in a seventh octave, each octave consisting of twelve keys corresponding to the notes of the chromatic scale. According to conventional musical notation, the lowest key on the keyboard of an organ corresponds to the C note of the second octave of a standard musical scale. Thus the twelve keys of the lowest octave on the keyboard may be designated as notes $C_2$ through $B_2$. The twelve notes of the next higher octave are the notes $C_3$ through $B_3$, with the highest note on the keyboard coresponding to the note $C_7$, making a total of sixty-one keys in all. To simplify a numerical designation of the sixty-one keys, the keys are given consecutive note numbers 1 through 61.

When a key is operated on the keyboard, it causes a digital tone generator to be assigned to that key by operation of a note detect and assignor circuit 14. A suitable note detect and assignor circuit is described in detail in U.S. Pat. No. 4,022,098. The note detect and assignor circuit stores digital information identifying which of the twelve notes in an octave has been keyed, the octave in which the note is keyed, and the particular keyboard. With a digital tone generator assigned to the keyed note, an executive control circuit 16 initiates a high speed computation mode in which the relative amplitude of a group of points defining the waveshape of one cycle (or half cycle) of the tone to be generated are computed and stored as a master data list. The amplitude values of the master data list are transferred sequentially at a rate proportional to the fundamental frequency of the tone being generated to a digital-to-analog converter, which converts the successive amplitude values to a corresponding changing analog voltage having the desired waveshape and frequency. This analog voltage is used to drive a conventional sound system.

The master data set in the polyphonic tone synthesizer is computed by the following discrete Fourier series $$Z_n = \sum_{q=1}^{M} c_q \sin(\pi ng/M) \quad \text{where } n = 1, 2 \ldots N \tag{1}$$

In the above equation, N is the number of points defining the waveshape and hence the number of computed values in the master data list, q designates the harmonic number, and M is the number of harmonics used to synthesize the master data list. $C_q$ represents the harmonic coefficient, there being one coefficient $C_q$ for each harmonic q. Typically the number of harmonics M is selected as 32 and N is selected as 64 points per full cycle.

At the start of a computation cycle, the executive control 16 starts the counting of a word counter 19, at the logic clock rate. With each advance of the word counter 19, a word is stored or modified in the main register 34, which stores N words comprising the master data list. Each word is the product of a harmonic coefficient read out of a harmonic coefficient memory 26 and a sinusoid or other orthogonal function value read out of a sinusoid table 24. With each advance of the word counter 19, a new value is addressed in the sinusoid table 24 and multiplied by the same harmonic coefficient. When the word counter reaches its maximum count, which corresponds to the number of words in the main register 34 comprising the master data list, a harmonic counter 20 advances one count. The harmonic counter 20 is used to address the harmonic coefficient memory 26. Thus each time the harmonic counter counts up one, a new set of N values is computed by multiplying the next higher harmonic coefficient read out of the memory 26 with the sine values read out of the sinusoid table 24. These values are added to the previously calculated set of values in the main register 34 by means of an adder 33. When the harmonic counter counts up to the value M corresponding to the highest order harmonic, the computation cycle is complete and the master data list defining the desired waveform is stored as N words in the main register 34, each word being the resultant sum of all the harmonic components for one point of the computed waveform.

As fully described in the above-identified patent No. 4,085,644, the master data list is then transferred from the main register 34 to a note register (not shown) from which the computed values of the master data list are transferred one word at a time in sequence, at a rate determined by the pitch of the note being generated, to a digital-to-analog converter to generate the corresponding analog waveform.

According to the present invention, the computation of the master data list is modified so that the resulting analog signal is modified as though it had passed through a fixed filter having a particular attenuation vs. frequency characteristic. Since the computation is entirely in the harmonic domain and is therefore independent or normalized with respect to frequency, the fixed formant filter of the present invention includes means for converting the true frequencies of the musical tone fundamental and its harmonics to scale factors which are used to modify the harmonic components used in computing the master data list. This is accomplished by converting all harmonic frequencies to equivalent keyboard note numbers. The frequency f of any harmonic of a note having a fundamental frequency $f_0$ is given by the relation $$f = qf_0 \tag{2}$$

where q is the harmonic number. The note number N of any harmonic can be determined by the following relationship:

$$N = 1 + \frac{12}{\log 2} \times \log(f/f_0) \tag{3}$$

where $F_0'$ is equal to 65.41 HZ, the frequency of the note $C_2$ (or note number N=1). The following table shows the note number according to the above equations for the first thrity-two harmonics of the note $C_2$.

| Harmonic | True Keyboard No. | Keyboard Number | Difference |
|---|---|---|---|
| 1 | 1.000 | 1 | 0.000 |

-continued

| Harmonic | True Keyboard No. | Keyboard Number | Difference |
|---|---|---|---|
| 2 | 13.000 | 13 | 0.000 |
| 3 | 20.020 | 20 | 0.020 |
| 4 | 25.000 | 25 | 0.000 |
| 5 | 28.863 | 29 | −0.137 |
| 6 | 32.020 | 32 | 0.020 |
| 7 | 34.688 | 35 | −0.312 |
| 8 | 37.000 | 37 | 0.000 |
| 9 | 39.039 | 39 | 0.039 |
| 10 | 40.863 | 41 | −0.137 |
| 11 | 42.513 | 43 | −0.487 |
| 12 | 44.020 | 44 | 0.020 |
| 13 | 45.405 | 45 | 0.405 |
| 14 | 46.688 | 47 | −0.312 |
| 15 | 47.883 | 48 | −0.117 |
| 16 | 49.000 | 49 | 0.000 |
| 17 | 50.050 | 50 | 0.050 |
| 18 | 51.039 | 51 | 0.039 |
| 19 | 51.975 | 52 | −0.025 |
| 20 | 52.863 | 53 | −0.137 |
| 21 | 53.708 | 54 | −0.292 |
| 22 | 54.513 | 55 | −0.487 |
| 23 | 55.283 | 55 | 0.283 |
| 24 | 56.020 | 56 | 0.020 |
| 25 | 56.726 | 57 | −0.274 |
| 26 | 57.405 | 57 | 0.405 |
| 27 | 58.059 | 58 | 0.059 |
| 28 | 58.688 | 59 | −0.312 |
| 29 | 59.296 | 59 | 0.296 |
| 30 | 59.883 | 60 | −0.117 |
| 31 | 60.450 | 60 | 0.450 |
| 32 | 61.000 | 61 | 0.000 |

It will be noted that the true equivalent note numbers for many of the harmonics based on equation 3 are not integers, as indicated in the second column of the table. The third column of the table lists the nearest integer value of the true note numbers and the last column tabulates the difference between the true note number and the closest integer. It is significant in implementing the present invention that the note numbers for the harmonics are relative. Thus for any note, the second harmonic, for example, will be twelve note numbers higher than the number of the first harmonic. The third harmonic will then be nineteen note numbers higher than the fundamental note number, etc. The thirty-second harmonic of the note $C_2$ corresponds to the note $C_7$ having a note number 61, which means that the thirty-second harmonic of the highest note on the keyboard, namely $C_7$ or note 61, will have a note number 121. It is also significant that the difference between the true note number of a harmonic and the integral number (column 4 of the table) is the same for the corresponding harmonic of all of the notes of the keyboard.

Figure 2:
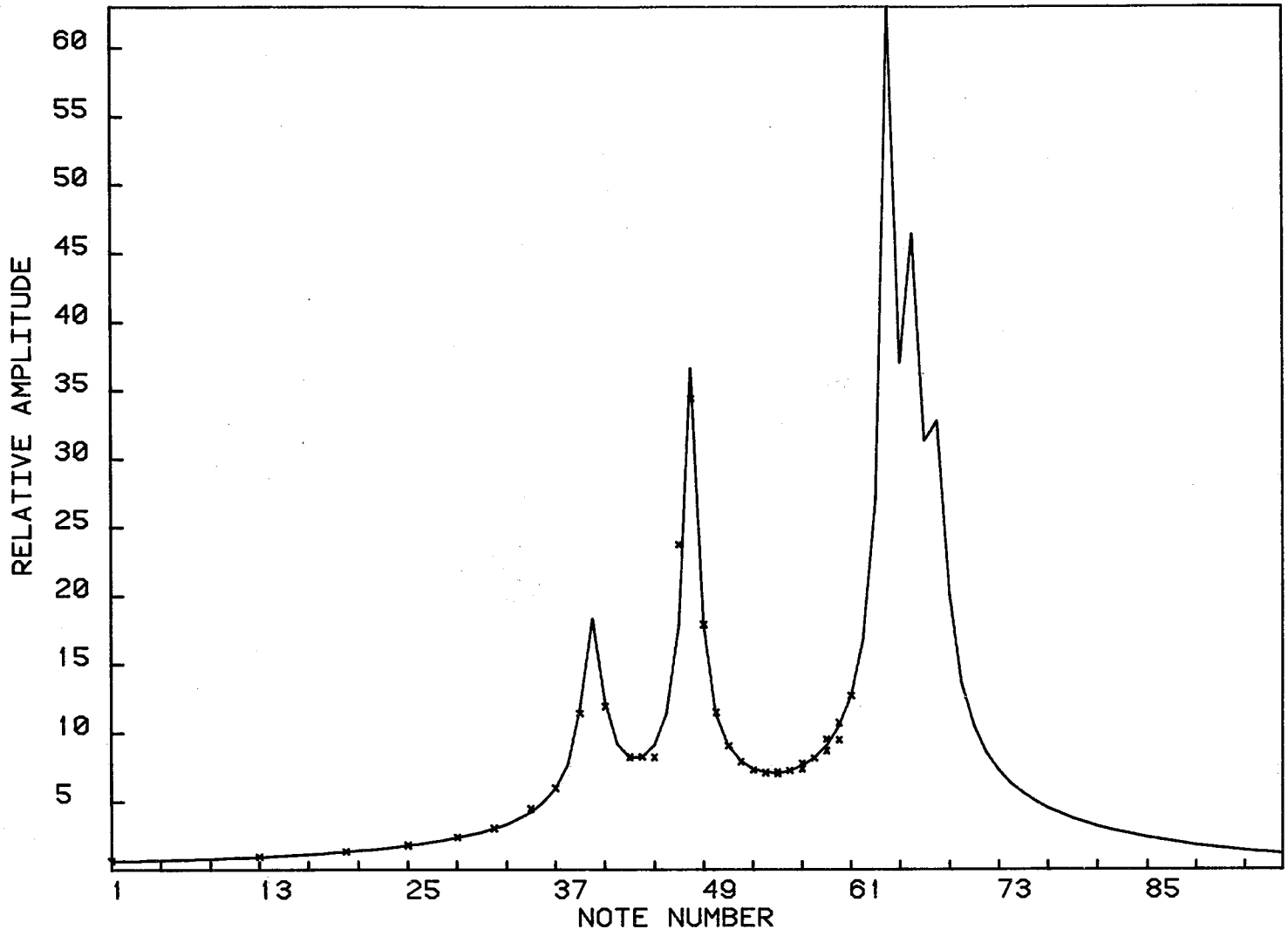
FIG. 2 is a graphic representation of a filter transfer characteristic corresponding to the human voice.

Since the fundamental and all higher order harmonics of each of the notes of the keyboard can be expressed as a note number, the fixed formant filter characteristic can be plotted with the X axis being a linear scale in note numbers and the Y axis being the relative amplitude, as shown in FIG. 2. It should be noted that the X axis correponds to a logarithmic plot of frequency. The transfer characteristic shown in FIG. 2 is typical of the human voice and is characterized by several strong resonant peaks at frequencies corresponding to note numbers 39, 48, and 64. Assuming one wanted to provide a fixed formant filter having the characteristic shown in FIG. 2, the relative amplitude of any harmonic of any note can be determined by locating the point on the curve corresponding to the note number of the particular harmonic. In FIG. 2, the points corresponding to the note numbers of the thirty-two harmonics of the fundamental at $C_2$ have been plotted. It will be seen that by knowing the note number of a harmonic component being used in a particular computation of a word in the master data list, the relative amplitude of the harmonic component can be modified according to desired filter characteristics, such as that shown in FIG. 2, to modify the resultant waveform to conform with the particular characteristic of the fixed formant filter.

Referring again to FIG. 1, a formant memory 105 is used to store one or more sets of scale factors, each set including a scale factor for each note number. Each set of scale factors in the memory correspond to the relative amplitudes of a fixed formant filter which it is desired to implement. For example, if a fixed formant filter having the characteristic shown in FIG. 2 were to be implemented, the scale factors for the harmonic components of the note $C_2$ would correspond to the plotted points.

The scale factors stored in the formant memory 105 are addressed by converting the group and note information stored in the note detect and assignor circuit 14 to the equivalent note number at the output of a keyboard number decoder circuit 101. This output is the note number of the operated key and is the same as the note number for the fundamental or first harmonic of the actuated key. For other than the first harmonic of a note, the note number is incremented by adding the note number increment of the particular harmonic as derived from a harmonic interval memory 102 to the note number from the decoder 101. The harmonic interval memory 102 stores the note number increments between the successive note numbers of columns 3 in the above table. The harmonic interval memory 102 is addressed by the output of the harmonic counter 20. Thus if the harmonic counter 20 indicates that the second harmonic component is being computed, the harmonic interval memory 102 will be addressed to read out the note number interval value "12", which is the number interval between the note number of the first and second harmonics. Similarly, if the harmonic counter 20 is counted to the third harmonic, the interval value "19" will be read out of the harmonic interval memory 102.

The output of the adder 109 is used to address the formant memory 105. If more than one set of scale factors is stored in the formant memory, a particular set is selected by closing a corresponding one of a group of STOP switches. The addressed scale factor is used to scale the computed harmonic component value at the output of the multiplier 28. The scale factor is preferably applied by a formant multiplier 74 which scales the output of the sinusoid table 24. However, it will be understood that the scale factor could as well be multiplied with the output of the harmonic coefficient memory 26 or the output of the multiplier 28 with equal effect.

Because the formant memory 105 stores scale factors only for the integral note numbers, whereas the frequency of a harmonic component of the tone being generated may not correspond to an integral note number, the scale factor read out of the formant memory 105 may be in error. The amount that the scale factor is in error depends on the slope of the curve defining the fixed formant filter transfer characteristic at the particular note number. Thus for harmonics in which the true note number is not an integer, the scale factor read out of the formant memory 105 is modified by interpolating between the scale factor read out of the formant memory 105 and the scale factor for the next adjacent integral note number. This is accomplished by providing a formant increment memory 104 which stores all the incremental values between successive scale factors stored in the formant memory 105. The formant increment memory 104 is addressed by the output of the adder 109 and the incremental value is applied to one input of a multiplier 150. The other input to the multiplier 150 is derived from a harmonic increment memory 103 which stores the difference values in column 4 of the above-identified table.

Figure 3:
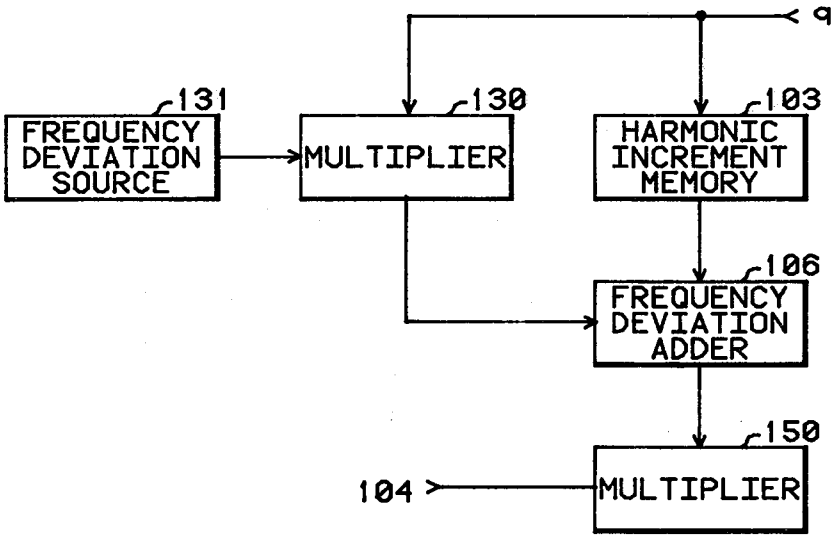
FIG. 3 is a schematic block diagram of a frequency deviation signal source.

The output of the multiplier 150 then is the scale factor correction which is added to the scale factor from the formant memory 105 by a formant adder 107. The output of the formant increment memory 104 and multiplier 150 is the difference value multiplied by the slope of the curve which converts the difference value to a corresponding incremental scale factor. A frequency deviation value can be added to the difference value from the harmonic increment memory 103 by an adder 106. By modifying the frequency deviation value as a function of time, a frequency modulation of the generated tone can be introduced. The frequency deviation values may be generated in any number of ways, such as shown in FIG. 3. A frequency deviation source 131 is provided which may be any suitable source of a frequency varying signal converted to digitized form. This could be a vibrato signal, a glide signal, the attack-/decay envelope signal from the ADSR generator, or the like. A multiplier 130 multiplies the signal from the frequency deviation source 131 by the current harmonic number q being used in the computation cycle. The output of the multiplier 130 is then summed with the output from the harmonic increment memory 103 by the adder 106.

It should be noted that for practical reasons the highest note number for which a scale factor is stored in the formant memory 107 is limited to 96, corresponding to a frequency of 15,804.27 Hz. This is sufficiently high to cover all audible frequencies. For all values at the output of the adder 109 exceeding 96, a zero scale factor is applied to the formant multiplier 108, thus in effect providing a cutoff of all frequencies above 15,804. Hz. If time economy is required during the computation cycles, automatic termination of the computation cycle can be implemented when the current value of the harmonic number q is such that the output of the adder 109 exceeds 96.

Figure 4:
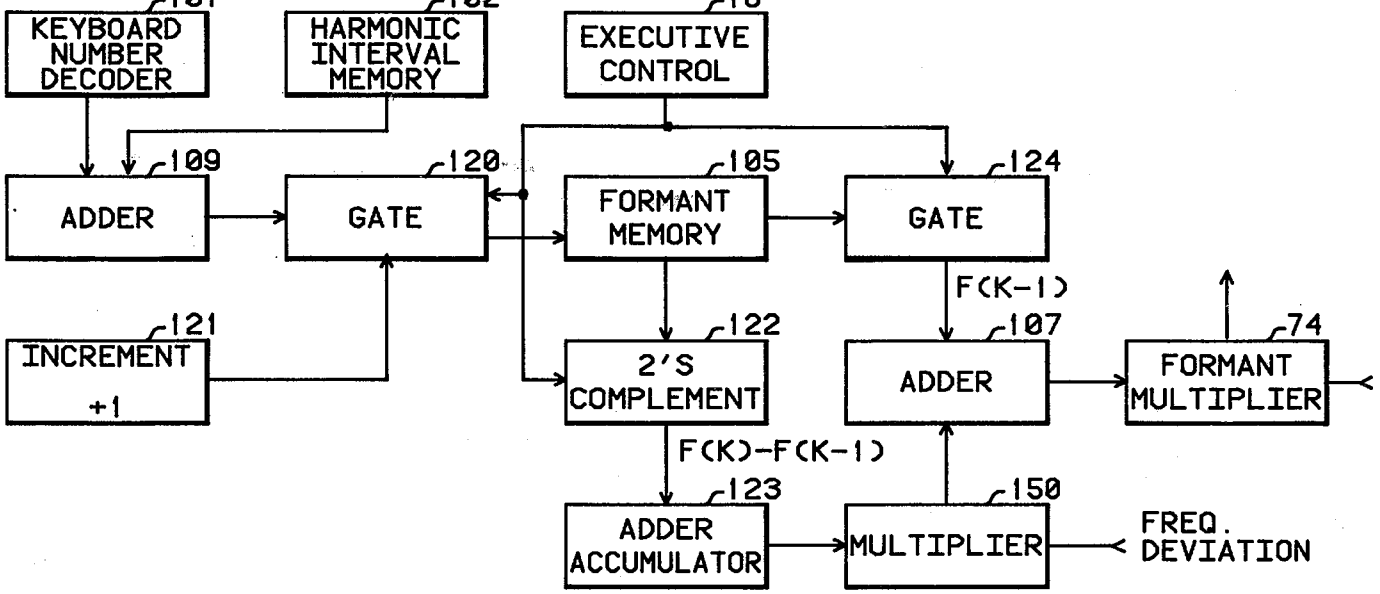
FIG. 4 is a schematic block diagram of an alternative embodiment of the present invention.

In the alternative embodiment of FIG. 4, rather than using a formant increment memory 104 to store the consecutive differences of the value stored in the formant memory 105, the difference values are computed by reading two successive values from the formant memory 105 and taking their difference to find the required increment value required for the interpolation. The output of the adder 109 is incremented by 1 by an increment circuit 121. A select gate 120 under control of the executive control 16 selects the output of the adder 109 or the incremented output from the increment circuit 121 to address the formant memory 105. The resulting value of F(K) from the formant memory 105 is transferred unaltered by a 2's complement circuit 122 to an adder-accumulator 123. The executive control 16 then causes the output of the adder 109 to address the formant memory 105 to read out the value F(K−1) which is applied to the adder accumulator through the 2's complement 122, thus providing an output at the adder-accumulator 123 corresponding to the difference between the two values F(K) and F(K−1) in the formant memory 105. The output of the adder-accumulator 123 is applied to the multiplier 150 and the output of the multiplier is added to the value F(K−1) from the formant memory 105, as selected by gate 124 under the control of the executive control 16.

Figure 5:
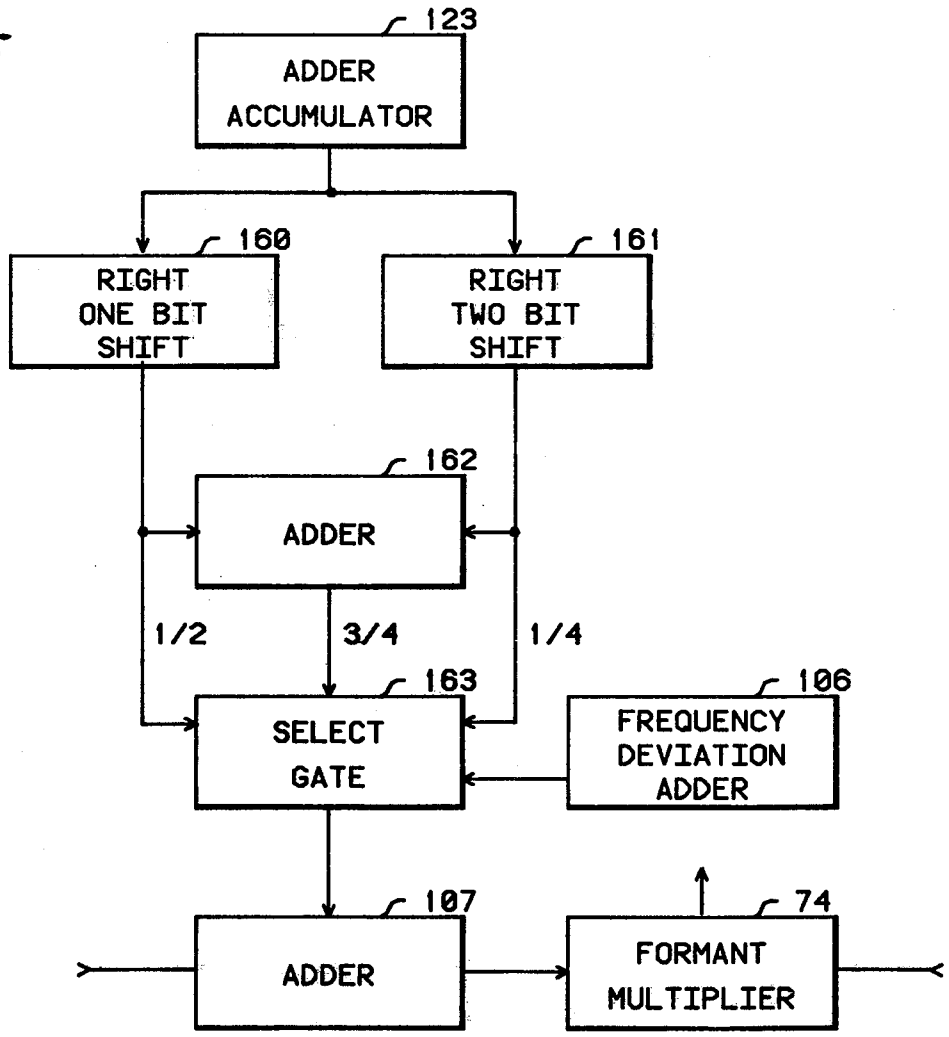
FIG. 5 is a schematic block diagram of a simplified multiplier useful in the embodiments of FIGS. 1 and 3.

The multiplier 150 of FIGS. 1–4 need not be a full multiplier but may be a simplified multiplier of the type shown in FIG. 5. The increment value from the formant increment memory 104 or the adder-accumulator 123 may be limited to increments of one-fourth, one-half, and three-fourths in scaling by the output of the frequency deviation adder 106. The equivalent of scaling by one-half can be accomplished by a 1 bit shift to the right of the output of the adder-accumulator 123, as indicated by the circuit 160. The scaling by a factor of one-fourth can be accomplished by shifting 2 bits to the right, as indicated by the circuit 161. Adding the outputs of the right 1 bit shift and right 2 bit shift by an adder 162 provides the equivalent of a scale factor of three-fourths. A select gate 163 in response to the frequency deviation adder 106 selects the nearest one of the three outputs for applying to the adder 107. Thus if the value of the output of the frequency deviation adder 106 has a value in the range 0 to $\frac{1}{4}$, the select gate 162 sends a 0 value to the adder 107. If the frequency deviation adder output is in the range of $\frac{1}{4}$ to $\frac{1}{2}$, the select gate 163 selects the value $\frac{1}{4}$, etc.

Figure 6:
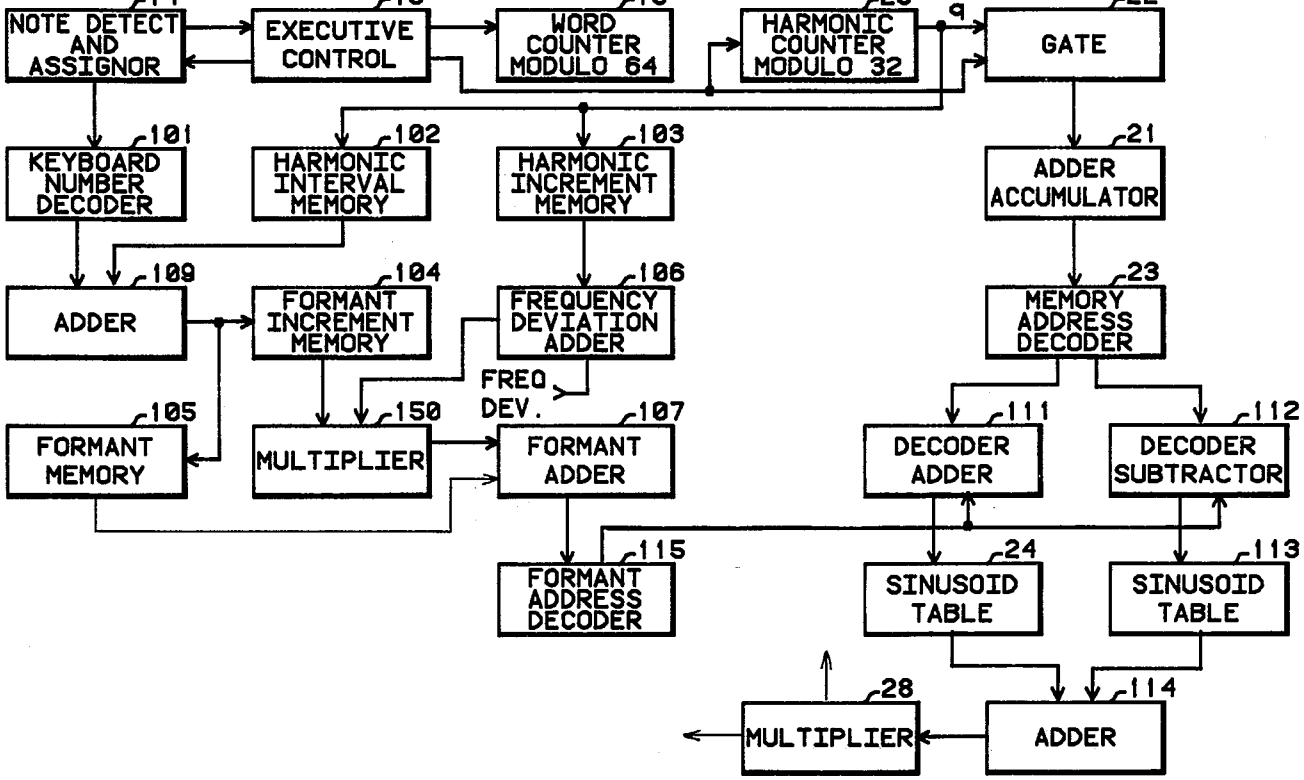
FIG. 6 is an alternative embodiment of a fixed formant filter which eliminates the need for formant multiplier.

FIG. 6 shows an arrangement by which the multiplier 74 of FIG. 1 can also be eliminated. The principal of the operation of FIG. 6 can best be understood by considering again the equation 1 for computing the master data set which can be rewritten as follows:

$$Z(n) = \sum_{q=1}^{32} g(q) \sin \pi nq/32 \tag{4}$$

The coefficients g(q) can be expressed as $$g(q) = c_q F(q) \tag{5}$$

where $c_q$ are the harmonic coefficients and F(q) are the formant filter factors expressed as a function of the harmonic number q as modified by the frequency deviation signal. The multiplication of the sine functions and the formant scale factor by the formant multiplier 74 is eliminated by using the known mathematical relationship $$2 \cos \phi \sin \theta = \sin (\theta + \phi) + \sin (\theta - \phi). \tag{6}$$

By letting $y = 2 \cos\phi$, this relationship can be rewritten as $$y \sin \theta = \sin (\theta + \phi) + \sin (\theta - \phi) \tag{7}$$

where $$\phi = \cos^{-1} y/2. \tag{8}$$

In the arrangement of FIG. 6, the contents of the formant memory 105 are stored as the values using the arcosine transformation of the above equation (8). The same transformation is used in storing the values in the formant increment memory 104 so that the output of the formant adder 107 is the equivalent value $\phi$ for the particular scale factor, preferably scaled by the constant $32/\pi$ so that the argument coincides with the trigonometric arguments in equation (4). The output of the formant adder 107 is converted to an address by a formant address decoder 115 and combined with the output of the memory address decoder 23. An adder 111 adds the two addresses while a subtractor 112 subtracts the output of the decoder 115 from the output of the memory address decoder 23. The resulting sum and difference values are used to address two sinusoid tables 24 and 113. The two outputs of the sinusoid tables are added by an adder 114 to provide the desired scale factor which in turn is applied to the multiplier 28.

Figure 7:
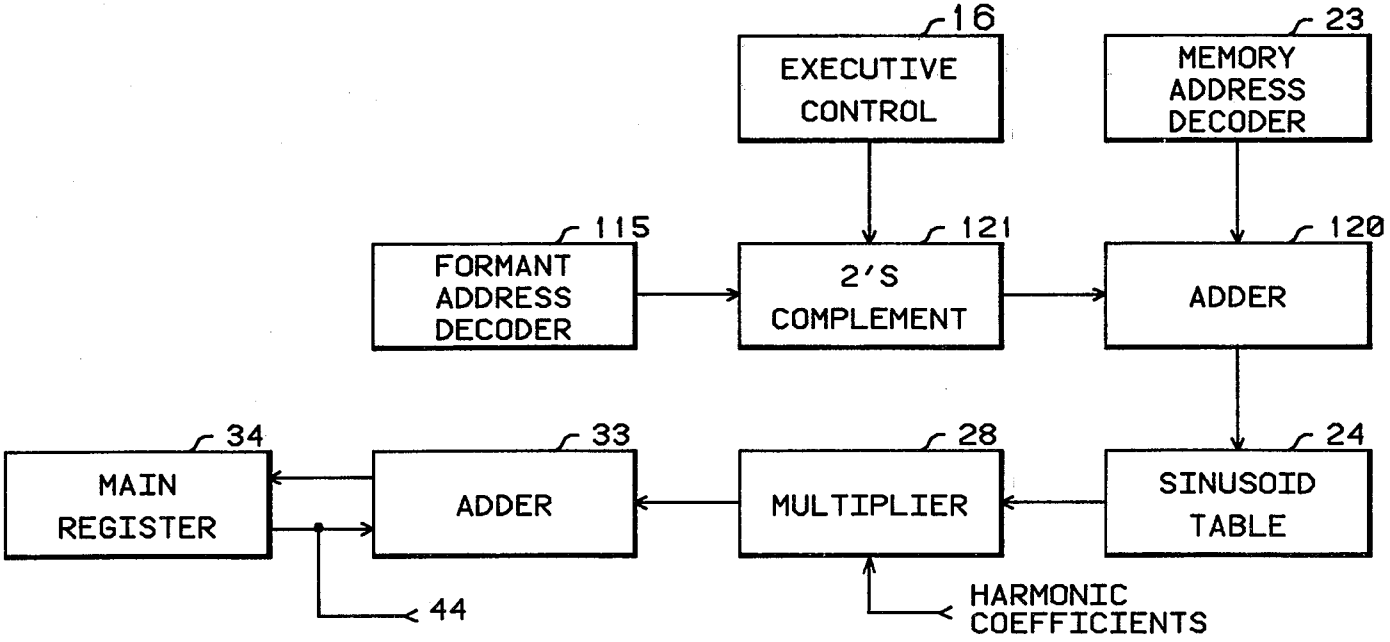
FIG. 7 is a schematic block diagram of an alternate embodiment of the system shown in FIG. 6.

FIG. 7 shows an alternative implementation of the system shown in FIG. 6. The arrangement of FIG. 7 allows a single sinusoid table to be used by dividing the computation cycle into two parts. During the first part, the output of the formant address decoder 115 is transferred unaltered to one input of the adder 120 where it is added to the output of the memory address decoder 23 for addressing the sinusoid table 24. During the second part of the computation cycle, without changing the value of q, a 2's complement circuit 121 is activated so that the value in the formant address decoder 115 is subtracted from the value in the memory address decoder 23 for addressing the sinusoid table 24. During the second half of the computation cycle, the output from the multiplier 28 is again added to the contents of the main register 34 by the adder 33 with the same net result as that achieved by the circuit arrangement of FIG. 6.

What is claimed is:

1. A tone generator having a fixed formant filter characteristic for generating a tone having a pitch selected by operating a key on a keyboard comprising a harmonic counter for counting the harmonic components of the tone being generated, means initiating a plurality of harmonic component calculation cycles, said means advancing the harmonic counter at the start of each calculation cycle, means storing a plurality of harmonic coefficient values, means reading out a different coefficient value from the storing means with each advance of the harmonic counter, means storing a plurality of sinusoid values, means reading out a sequence of sinusoid values with each setting of the harmonic counter, adder-accumulator means, means multiplying the coefficient value for each harmonic calculation cycle with a sequence of sinusoid values and adding the product values to the adder-accumulator, addressable means storing a plurality of scale factors corresponding to the relative amplitude values of the fixed formant filter characteristic at predetermined frequencies corresponding to the musical notes of the keyboard, means for addressing the addressable storage means in response to the selected key on the keyboard and the state of the harmonic counter, means multiplying each of said product values added to the adder-accumulator by the associated scale factor read out of the storage means, and means converting each of the values stored in the adder-accumulator at the completion of said calculation cycles to an analog voltage in sequence at a rate determined by the pitch of the tone being generated, whereby the set of values stored in the adder-accumulator is converted to an audio voltage signal having a fundamental frequency corresponding to the desired pitch of tone being generated, means for modifying the scale factor read out of the addressable scale factor storing means including means for generating the incremental difference between successive scale factors read out of the scale factor storing means, means generating a frequency deviation value, means multiplying said incremental difference by said deviation value, and means adding the content of the multiplying means to the scale factor from the scale factor storing means.

2. Apparatus of claim 1 wherein the means generating the frequency deviation value is varied as a function of time to produce a frequency modulation effect.

3. Apparatus of claim 1 wherein the means generating a deviation value is controlled in response to the state of the harmonic counter.

4. Apparatus of claim 1 wherein said means multiplying said incremental difference by said deviation value includes means providing a one bit right shift of said incremental difference, means providing a two bit right shift of said incremental difference, means providing the sum of the output from the one bit right shift means and the two bit right shift means, and means responsive to said deviation value for selecting any one or none of said outputs as input to said means adding the output of the multiplying means to the scale factor.

5. A polyphonic digital tone synthesizer, comprising: a keyboard having keys for initiating one or more musical notes, a main register for storing a set of coded values corresponding to the relative amplitudes of a set of points defining one cycle of a periodic musical waveform, a digital-to-analog converter, means responsive to operation of a selected key for transferring the coded values in sequence from the main register to the converter at a rate proportional to the pitch of the note initiated by the selected key, means for computing the set of coded values and storing them in the main register including means storing a set of harmonic coefficients, means storing a set of orthogonal function values, means multiplying each harmonic coefficient in succession with a set of orthogonal values to produce a succession of computed sets of values defining respectively each harmonic of the desired waveform, and means for adding the successive sets of values and accumulating the sums in the main register, addressable storage means storing at least one set of scale factors defining the gain characteristic of the fixed formant filter over the audio frequency range, means generating addresses for addressing the addressable storage means including means generating a unique address for each key on the keyboard and means adding a unique incremental value to said address for each harmonic being computed, and means applying the scale factor addressed in said addressable storage means to said scaler means to apply a different scale factor for each computed set of values defining each harmonic of the desired waveform, said means applying the scale factor including means for adjusting the scale factor read out of the addressable storage means, said adjusting means including means for providing the incremental difference between the scale factor read out of the storage means and the scale factor at the next successive address of the storage means, means for multiplying said incremental difference by a frequency deviation signal, and means for adding the output of the multiplying means to the scale factor read out of the storage means.

6. Apparatus of claim 5 further including means for storing incremental adjustment factors corresponding to the difference between the scale factor stored in said addressable storage means and the actual scale factor for the corresponding frequency point on the desired fixed filter characteristic curve, there being a separate adjustment factor for each harmonic, and means addressing the incremental adjustment factor storing means by the number of the harmonic component being generated, the output adjustment factor being added to the frequency deviation signal applied to the multiplying means.

* * * * *